US011435089B2

(12) United States Patent
Kozinski et al.

(10) Patent No.: US 11,435,089 B2
(45) Date of Patent: Sep. 6, 2022

(54) RETRACTABLE DISPLAY FOR AN OVEN APPLIANCE

(71) Applicant: Haier US Appliance Solutions, Inc., Wilmington, DE (US)

(72) Inventors: Kyle Andrew Kozinski, Buffalo, NY (US); Joshua Adam Mayne, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 48 days.

(21) Appl. No.: 17/009,860

(22) Filed: Sep. 2, 2020

(65) Prior Publication Data

US 2022/0065458 A1 Mar. 3, 2022

(51) Int. Cl.
*F24C 7/08* (2006.01)
*F24C 15/00* (2006.01)

(52) U.S. Cl.
CPC ..... *F24C 7/085* (2013.01); *F24C 15/00* (2013.01)

(58) Field of Classification Search
CPC ... F24C 7/082; F24C 15/2042; F24C 15/2085
USPC ..... 219/393, 622, 679
See application file for complete search history.

(56) References Cited

U.S. PATENT DOCUMENTS 6,359,270 B1 * 3/2002 Bridson ..... G10L 15/26 219/679
6,809,295 B1 * 10/2004 Vargas ..... F24C 7/082 219/209
7,836,877 B2 11/2010 Dembinski
2006/0237424 A1 * 10/2006 Haberkamm ..... F24C 15/325 219/400
2006/0278215 A1 * 12/2006 Gagas ..... F24C 15/2042 126/299 D
2010/0065038 A1 3/2010 Davies
2013/0092032 A1 4/2013 Cafferty
2014/0034040 A1 * 2/2014 Sinur ..... F24C 15/2021 126/299 D
2017/0099988 A1 * 4/2017 Matloubian ..... A47J 37/0664
2018/0283699 A1 * 10/2018 Armstrong ..... F24C 15/2092

FOREIGN PATENT DOCUMENTS

CN 206222391 U 6/2017
EP 3553388 A1 10/2019

* cited by examiner

*Primary Examiner* — Thien S Tran
(74) *Attorney, Agent, or Firm* — Dority & Manning, P.A.

(57) ABSTRACT

A display assembly for an appliance includes an outer frame mounted to or positioned within a cabinet of an appliance and a screen assembly slidably mounted to the outer frame. A drive mechanism, such as an electric drive motor rotating a threaded rod, is operably coupled to the screen assembly for moving the screen assembly between an extended position where it is visible and accessible for user interaction and a retracted position where it is concealed from view.

20 Claims, 9 Drawing Sheets

RETRACTABLE DISPLAY FOR AN OVEN APPLIANCE

FIELD OF THE INVENTION

The present subject matter relates generally to oven appliances, and more particularly, to retractable displays for oven appliances.

BACKGROUND OF THE INVENTION

Conventional residential and commercial oven appliances generally include a cabinet that includes a cooking chamber for receipt of food items for cooking. Multiple heating elements are positioned within the cooking chamber to provide heat to food items located therein. The heating elements can include, for example, radiant heating elements, such as a bake heating assembly positioned at a bottom of the cooking chamber and/or a separate broiler heating assembly positioned at a top of the cooking chamber.

Conventional ovens also frequently include a control panel that includes a display, indicator lights, buttons for regulating oven operation, and/or one or more control knobs for regulating the heat output of various heating elements. However, such control panels often lack interactive capabilities which are desirable to the consumer. In addition, these control panels are typically fixed to the back of the oven appliance or to a front end of the oven appliance. Such fixed positioning is often unattractive and obtrusive to consumers, who frequently prefer a cleaner look. In addition, such fixed control panels are more commonly subject to contaminants, such as oil splashes or food spillage. Moreover, such control panels are often difficult to clean, resulting in an unsightly and undesirable appearance.

Accordingly, an oven appliance with an improved display and control interface is desirable. More particularly, an interactive display that permits improved user interaction and functionality with the oven appliance while improving appearance and aesthetics would be especially beneficial.

BRIEF DESCRIPTION OF THE INVENTION

Aspects and advantages of the invention will be set forth in part in the following description, or may be apparent from the description, or may be learned through practice of the invention.

In one exemplary embodiment, an oven appliance defining a vertical direction, a lateral direction, and a transverse direction is provided. The oven appliance includes a cabinet and a display assembly movably mounted to the cabinet. The display assembly includes an outer frame mounted to the cabinet, a screen assembly slidably mounted to the outer frame, and a drive mechanism for selectively moving the screen assembly between an extended position and a retracted position.

In another exemplary embodiment, a display assembly for an appliance is provided. The appliance includes a cabinet defining a vertical direction and the display assembly includes an outer frame mounted to the cabinet, a screen assembly slidably mounted to the outer frame, and a drive mechanism for selectively moving the screen assembly between an extended position and a retracted position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
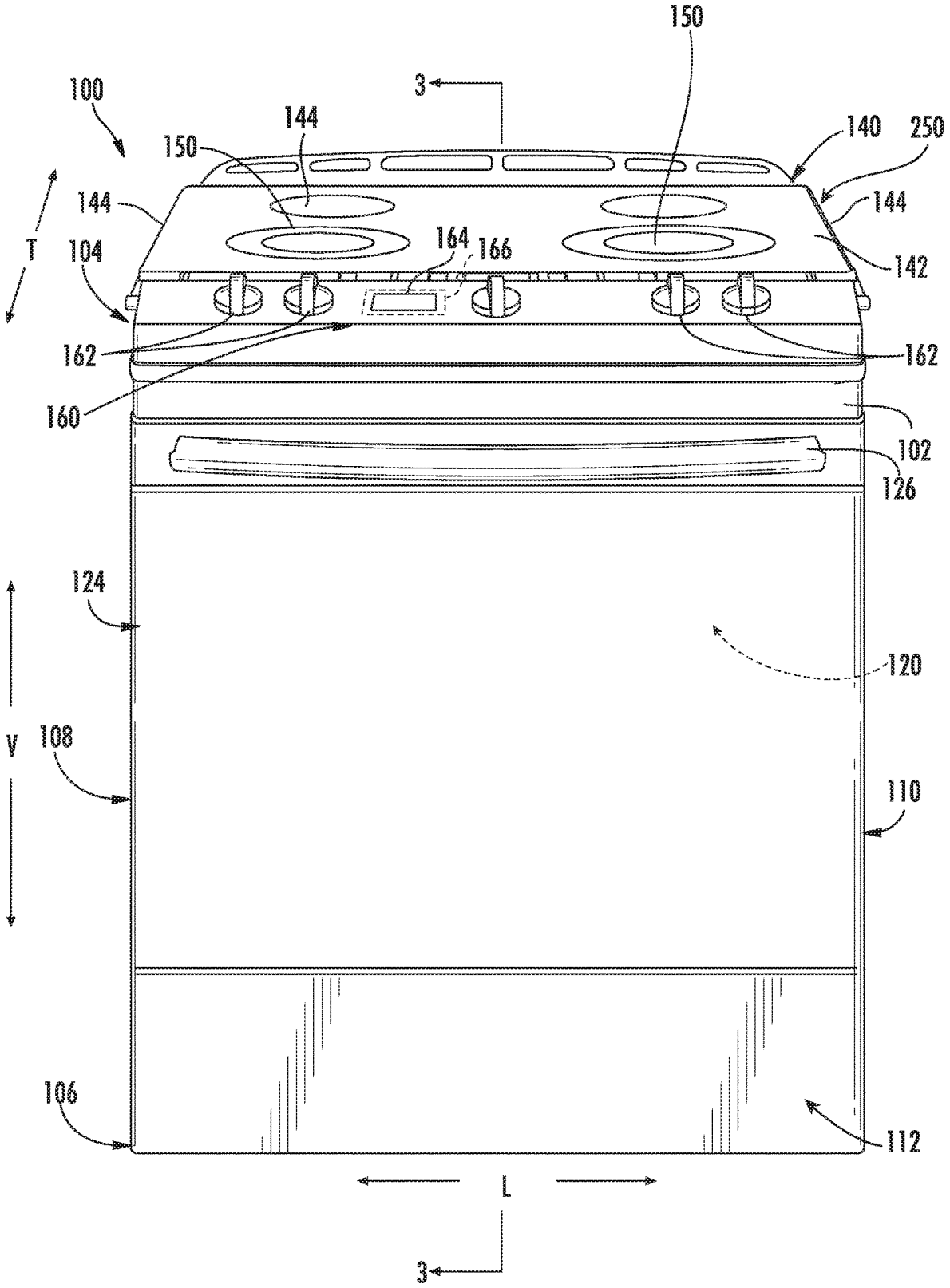
FIG. 1 provides a front perspective view of a cooking appliance with a display assembly in a retracted position according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "approximately," "substantially," or "about," refer to being within a ten percent (10%) margin of error of the stated value. Moreover, as used herein, the terms "first," "second," and "third" may be used interchangeably to distinguish one component from another and are not intended to signify location or importance of the individual components.

FIG. 1 provides a front, perspective view of an oven appliance 100 as may be employed with the present subject matter. Oven appliance 100 generally defines a vertical direction V, a lateral direction L, and a transverse direction T, each of which is mutually perpendicular, such that an orthogonal coordinate system is generally defined. As illustrated, oven appliance 100 includes an insulated cabinet 102. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Within cabinet 102 is a single cooking chamber 120 which is configured for the receipt of one or more food items to be cooked. However, it should be appreciated that oven appliance 100 is provided by way of example only, and aspects of the present subject matter may be used in any suitable cooking appliance, such as a double oven range appliance. Thus, the example embodiment shown in FIG. 1 is not intended to limit the present subject matter to any particular cooking chamber configuration or arrangement. Indeed, aspects of the present subject matter may be applied to display assemblies for any suitable appliance.

Oven appliance 100 includes a door 124 rotatably attached to cabinet 102 in order to permit selective access to cooking chamber 120. Handle 126 is mounted to door 124 to assist a user with opening and closing door 124 in order to access cooking chamber 120. As an example, a user can pull on handle 126 mounted to door 124 to open or close door 124 and access cooking chamber 120. One or more transparent viewing windows 128 (FIG. 1) may be defined within door 124 to provide for viewing the contents of cooking chamber 120 when door 124 is closed and also assist with insulating cooking chamber 120.

Figure 3:
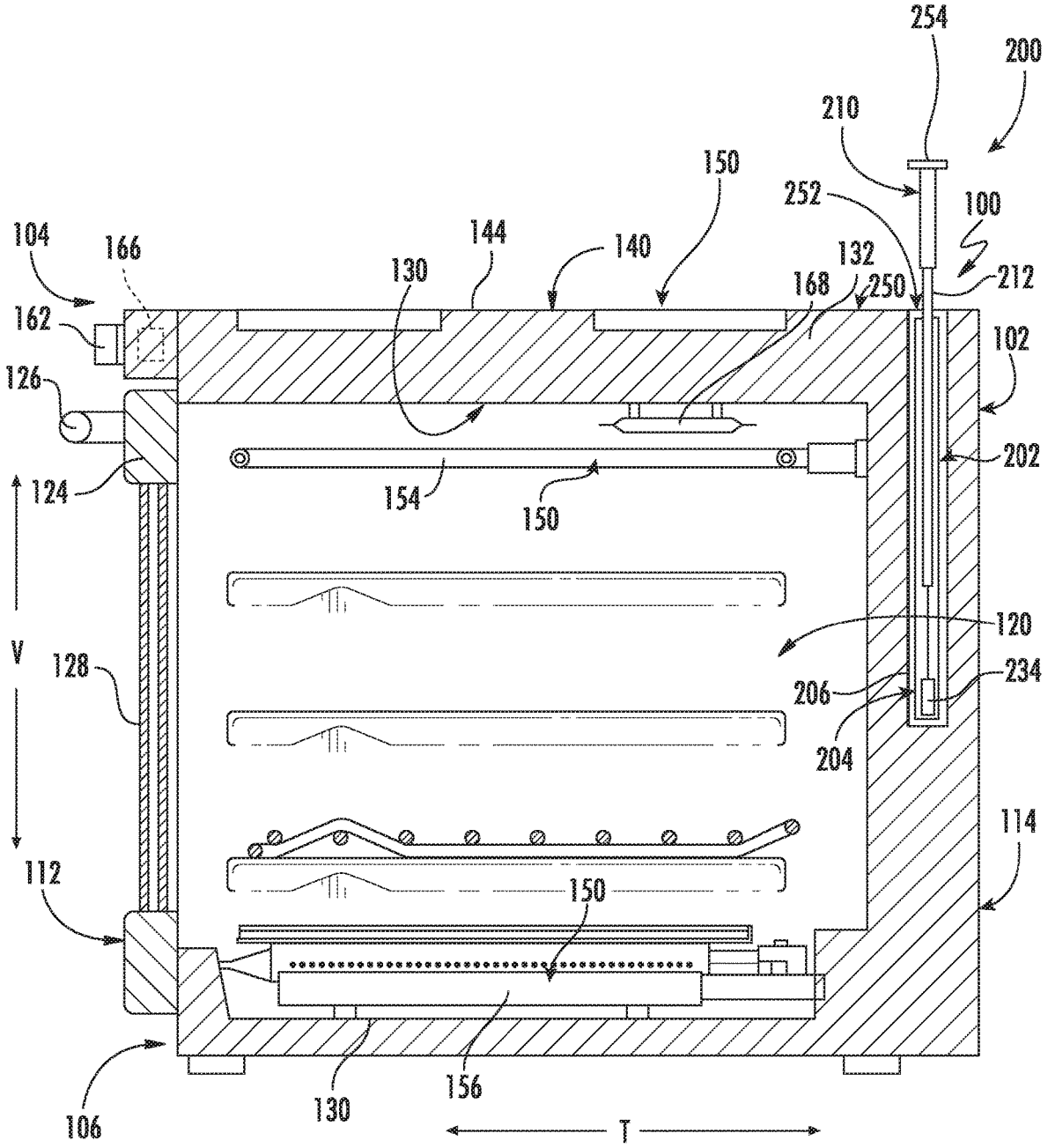
FIG. 3 provides a side cross sectional view of the exemplary cooking appliance of FIG. 1 with the display assembly in the extended position according to an exemplary embodiment of the present subject matter.

In general, cooking chamber 120 is defined by a plurality of chamber walls 130 (FIG. 3). Specifically, cooking chamber 120 may be defined by a top wall, a rear wall, a bottom wall, and two sidewalls 130. These chamber walls 130 may be joined together to define an opening through which a user may selectively access cooking chamber 120 by opening door 124. In order to insulate cooking chamber 120, oven appliance 100 includes an insulating gap defined between the chamber walls 130 and cabinet 102. According to an exemplary embodiment, the insulation gap is filled with an insulating material 132, such as insulating foam or fiberglass, for insulating cooking chamber 120.

Oven appliance 100 also includes a cooktop 140. Cooktop 140 is positioned at or adjacent top 104 of cabinet 102 such that it is positioned above cooking chamber 120. Specifically, cooktop 140 includes a top panel 142 positioned proximate top 104 of cabinet 102. By way of example, top panel 142 may be constructed of glass, ceramics, enameled steel, and combinations thereof. One or more grates 144 are supported on a top surface of top panel 142 for supporting cooking utensils, such as pots or pans, during a cooking process.

Oven appliance 100 may further include one or more heating elements (identified generally by reference numeral 150) for selectively heating cooking utensils positioned on glass panel 144 or food items positioned within cooking chamber 120. For example, referring to FIG. 1, heating elements 150 may be electric burners 150. Specifically, a plurality of electric burners 150 are mounted within or on top of top panel 142 underneath a glass panel 144 that supports cooking utensils over the electric burners 150 while electric burners 150 provide thermal energy to cooking utensils positioned thereon, e.g., to heat food and/or cooking liquids (e.g., oil, water, etc.). Electric burners 150 can be configured in various sizes so as to provide e.g., for the receipt of cooking utensils (i.e., pots, pans, etc.) of various sizes and configurations and to provide different heat inputs for such cooking utensils. According to alternative embodiments, oven appliance 100 may have other cooktop configurations or burner elements.

In addition, heating elements 150 may be positioned within or may otherwise be in thermal communication with cooking chamber 120 for regulating the temperature within cooking chamber 120. Specifically, an upper gas heating element 154 (also referred to as a broil heating element or gas burner) may be positioned in cabinet 102, e.g., at a top portion of cooking chamber 120, and a lower gas heating element 156 (also referred to as a bake heating element or gas burner) may be positioned at a bottom portion of cooking chamber 120. Upper gas heating element 154 and lower gas heating element 156 may be used independently or simultaneously to heat cooking chamber 120, perform a baking or broil operation, perform a cleaning cycle, etc. The size and heat output of gas heating elements 154, 156 can be selected based on the, e.g., the size of oven appliance 100 or the desired heat output. Oven appliance 100 may include any other suitable number, type, and configuration of heating elements 150 within cabinet 102 and/or on cooktop 140. For example, oven appliance 100 may further include electric heating elements, induction heating elements, or any other suitable heat generating device.

A user interface panel 160 is located within convenient reach of a user of the oven appliance 100. For this example embodiment, user interface panel 160 includes knobs 162 that are each associated with one of heating elements 150. In this manner, knobs 162 allow the user to activate each heating element 150 and determine the amount of heat input provided by each heating element 150 to a cooking food items within cooking chamber 120 or on cooktop 140. Although shown with knobs 162, it should be understood that knobs 162 and the configuration of oven appliance 100 shown in FIG. 1 is provided by way of example only. More specifically, user interface panel 160 may include various input components, such as one or more of a variety of touch-type controls, electrical, mechanical or electro-mechanical input devices including rotary dials, push buttons, and touch pads. User interface panel 160 may also be provided with one or more graphical display devices or display components 164, such as a digital or analog display device designed to provide operational feedback or other information to the user such as e.g., whether a particular heating element 150 is activated and/or the rate at which the heating element 150 is set.

Generally, oven appliance 100 may include a controller 166 in operative communication with user interface panel 160. User interface panel 160 of oven appliance 100 may be in communication with controller 166 via, for example, one or more signal lines or shared communication busses, and signals generated in controller 166 operate oven appliance 100 in response to user input via user input devices 162. Input/Output ("I/O") signals may be routed between controller 166 and various operational components of oven appliance 100 such that operation of oven appliance 100 can be regulated by controller 166. In addition, controller 166 may also be communication with one or more sensors, such as temperature sensor 168 (FIG. 3), which may be used to measure temperature inside cooking chamber 120 and provide such measurements to the controller 166. Although temperature sensor 168 is illustrated at a top and rear of cooking chamber 120, it should be appreciated that other sensor types, positions, and configurations may be used according to alternative embodiments.

Controller 166 is a "processing device" or "controller" and may be embodied as described herein. Controller 166 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 166 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Although aspects of the present subject matter are described herein in the context of a single oven appliance, it should be appreciated that oven appliance 100 is provided by way of example only. Other oven or range appliances having different configurations, different appearances, and/or different features may also be utilized with the present subject matter, e.g., double ovens, standalone cooktops, etc.

Figure 2:
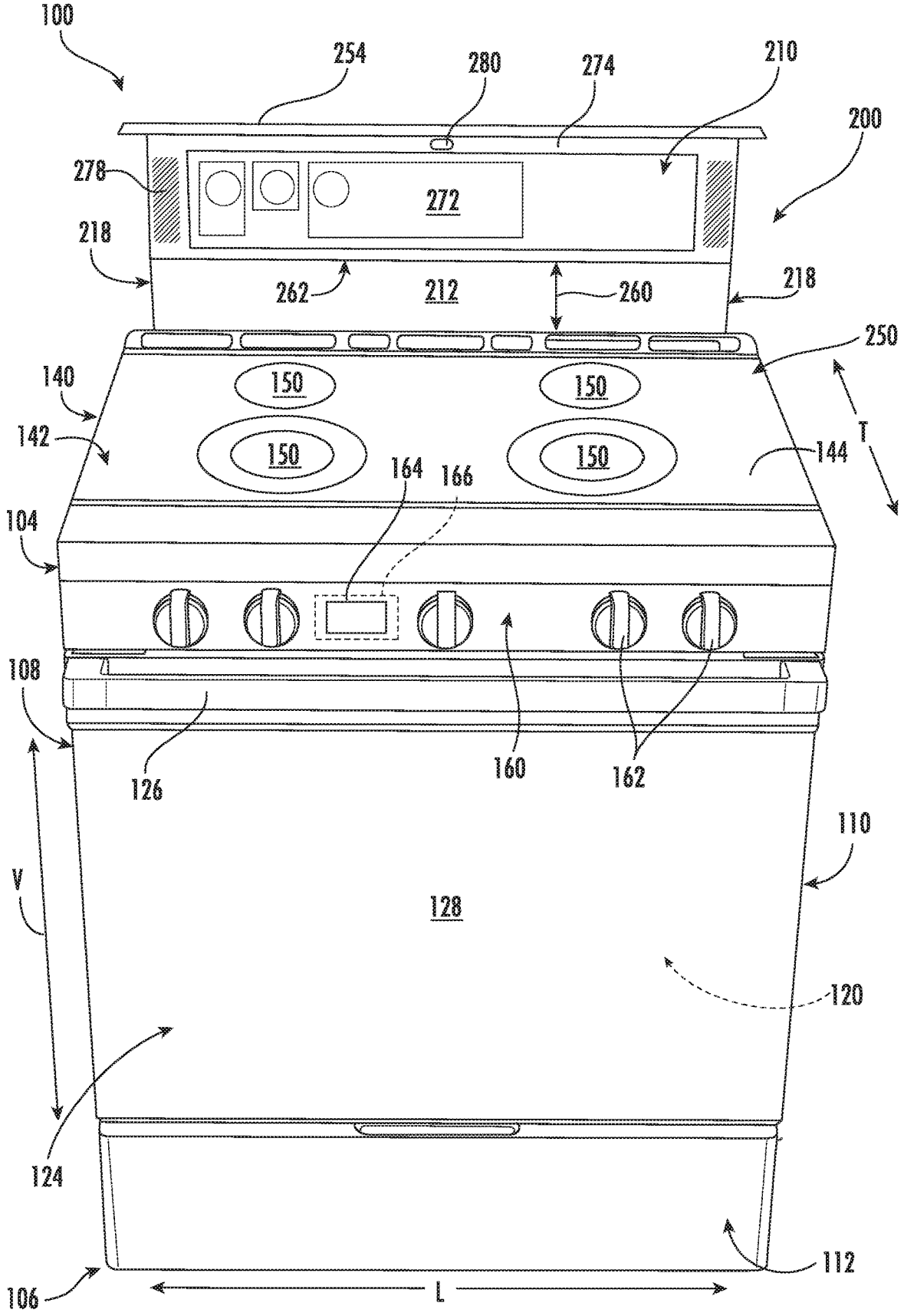
FIG. 2 provides a front perspective view of the exemplary cooking appliance of FIG. 1 with the display assembly in an extended position according to an exemplary embodiment of the present subject matter.

Referring now generally to FIGS. 1 through 7, a display assembly 200 will be described according to exemplary embodiments of the present subject matter. As illustrated and described below, display assembly 200 is generally an extendable and retractable display assembly 200, e.g., such as a telescoping display assembly. In this regard, display assembly 200 may move between a retracted position (e.g., as shown in FIG. 1) and an extended position (e.g., as shown in FIG. 2). In this manner, display assembly 200 may be selectively extended to provide a user with useful information or allow a user to interactively control oven appliance 100. In addition, display assembly 200 may be retracted to provide a clean, unobtrusive look to oven appliance 100.

Although display assembly 200 is described herein as being used with oven appliance 100, it should be appreciated that aspects of the present subject matter may be applied to any other suitable appliance where an interactive and retractable display is desirable. In addition, it should be appreciated that display assembly 200 may be operably coupled with controller 166 of oven appliance 100 and may be used in conjunction with or independently of user interface panel 160. Indeed, according to exemplary embodiments of the present subject matter, user interface panel 160 may be removed entirely such that display assembly 200 is the primary user interface for operating oven appliance 100 and facilitating user interaction. Display assembly 200 may have other configurations and be used in other manners while remaining within the scope of the present subject matter.

According to the illustrated embodiment, display assembly 200 is positioned proximate rear 114 of oven appliance 100. In addition, display assembly 200 is illustrated as being movable along the vertical direction V. However, it should be appreciated that according to alternative embodiments, display assembly 200 may be positioned at any other suitable location, may be mounted in any other suitable manner, and may have any other suitable range of motion while remaining within the scope of the present subject matter. Furthermore, although display assembly 200 is described herein primarily with regard to its display and control functionalities, it should be appreciated that according to alternative embodiments, display assembly may include other suitable features, such as a cooktop lighting assembly, a downdraft vent assembly, or any other suitable features.

Figure 4:
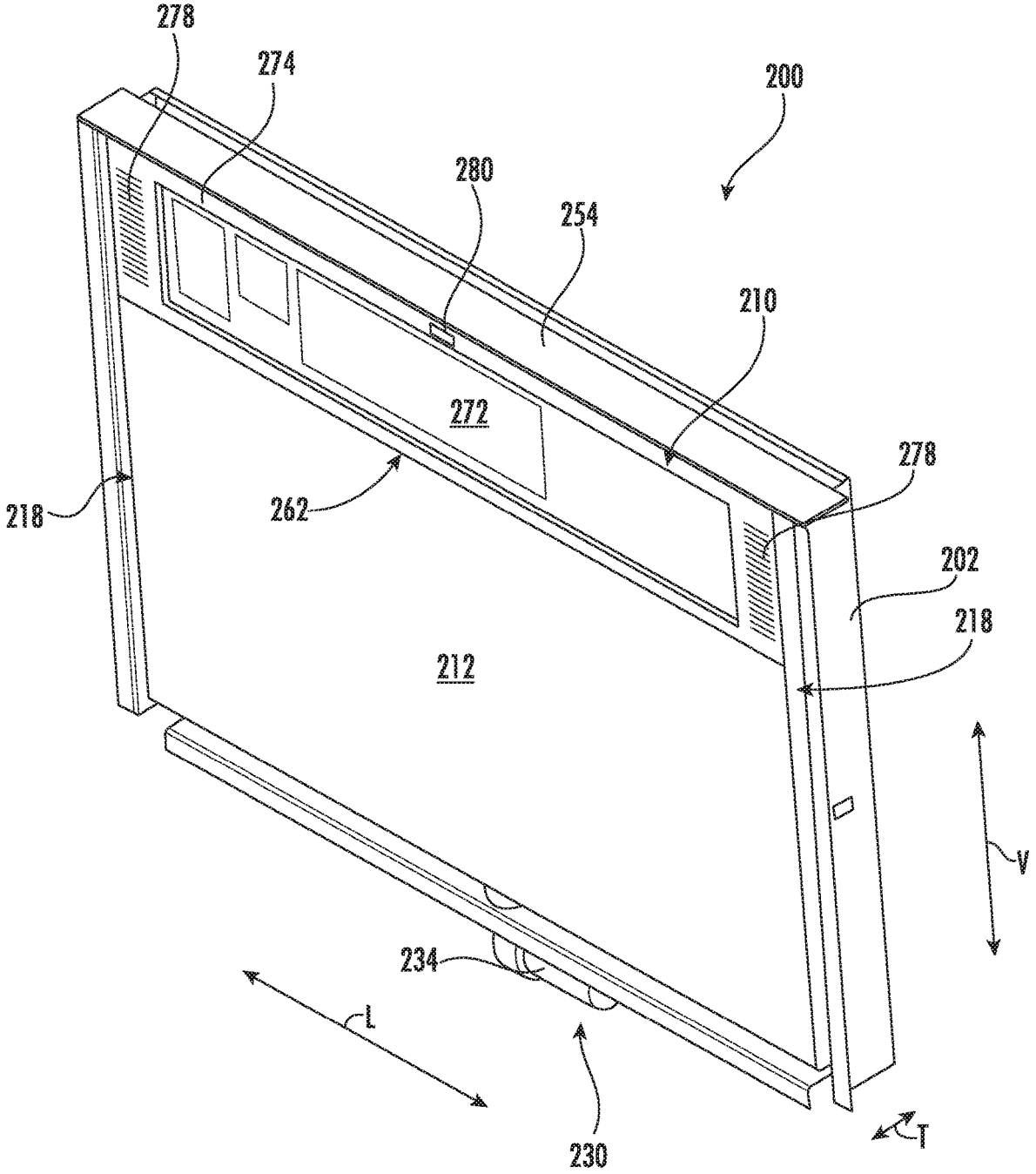
FIG. 4 provides a perspective view of the exemplary display assembly of FIG. 1 with a screen assembly in the retracted position according to an exemplary embodiment of the present subject matter.
Figure 5:
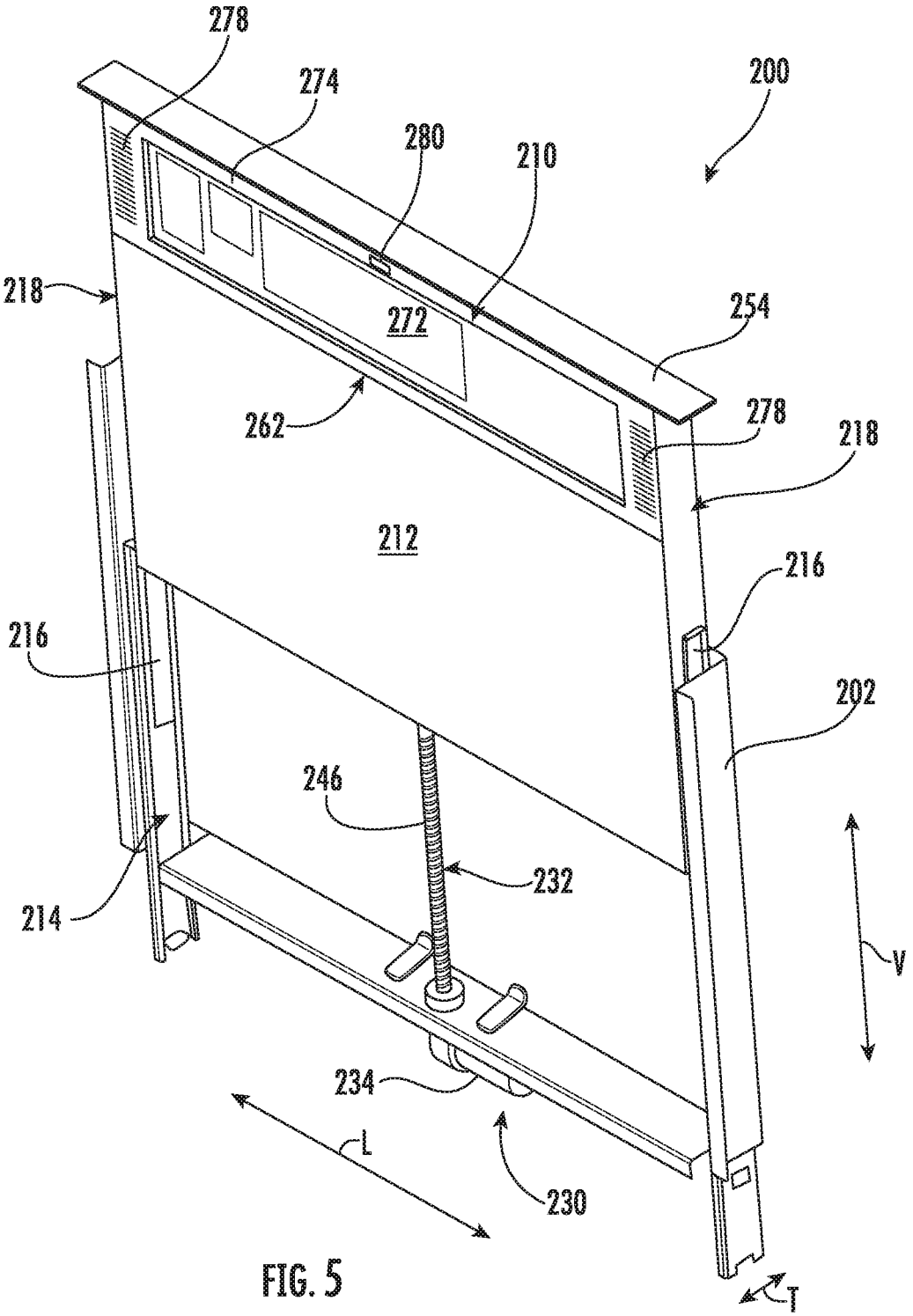
FIG. 5 provides a perspective view of the exemplary display assembly of FIG. 1 with the screen assembly in the extended position according to an exemplary embodiment of the present subject matter.
Figure 9:
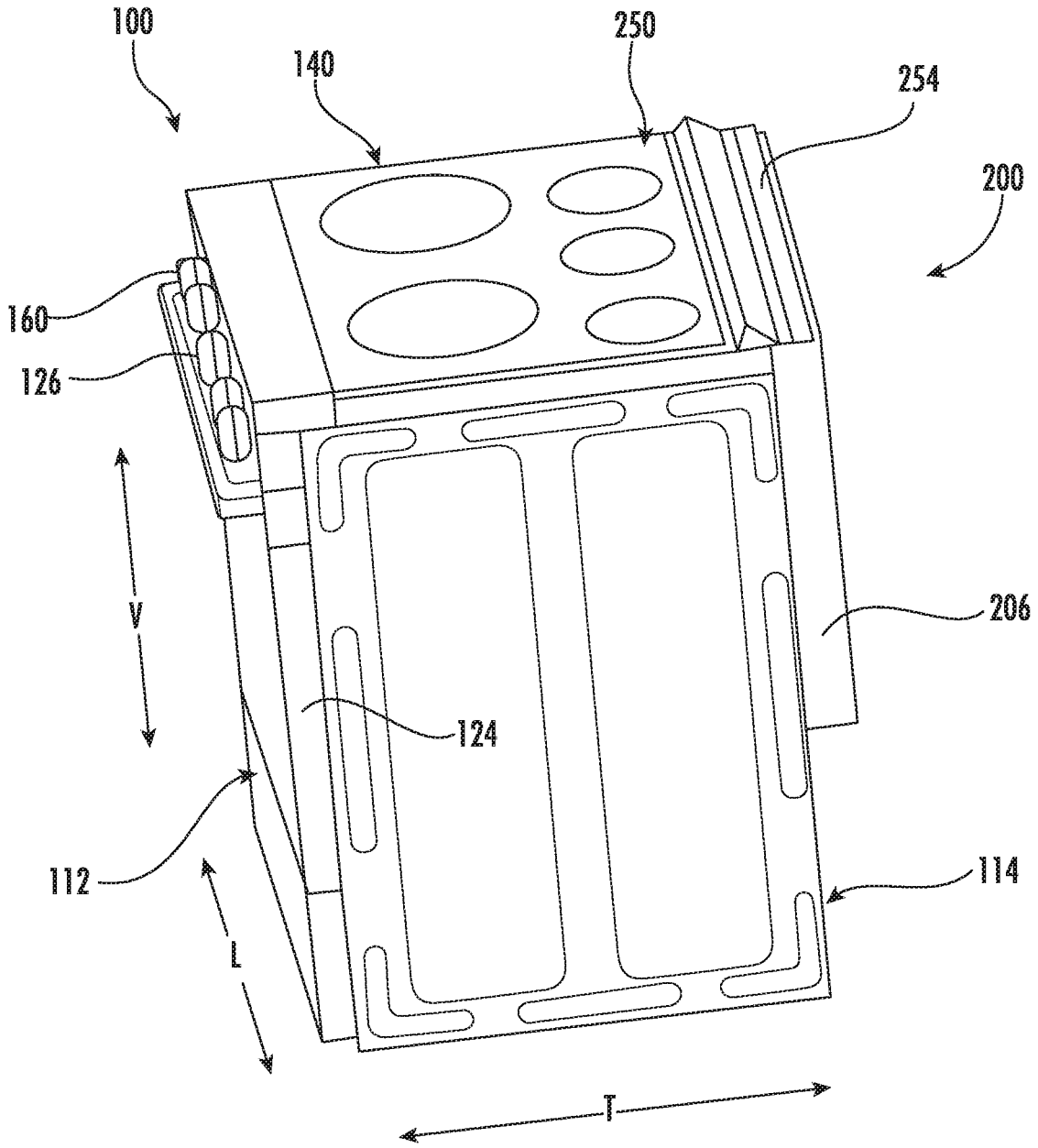
FIG. 9 provides a perspective view of a cooking appliance with a display assembly in a retracted position according to another exemplary embodiment of the present subject matter.

Referring now specifically to FIGS. 3 through 5, display assembly 200 may generally include an outer frame 202 that is mounted to cabinet 102. More specifically, as best shown in FIG. 3, oven appliance 100 may include a receiving slot 204 that is defined between a rear wall 114 of cabinet 102 and a rear chamber wall 130 of cooking chamber 120 along the transverse direction T. In this regard, receiving slot 204 is generally a void within cabinet 102 that is suitably sized for receiving display assembly 200 such that it may be concealed when not in use or when otherwise desired. For example, receiving slot 204 may be defined by a display housing 206 that is positioned within insulating material 132 or otherwise mounted to insulating cabinet 102. Notably, although display housing 206 is illustrated herein as being positioned entirely within cabinet 102, it should be appreciated that according to alternative embodiments display housing 206 may be positioned at any other suitable location. For example, referring briefly to FIG. 9, according to an alternative embodiment, display housing 206 may be mounted onto rear wall 114 of cabinet 102. In this manner, display assembly 200 may be an add-on feature that can be purchased separately and integrated with older oven appliances, e.g., to upgrade the older appliance and/or to make the appliance a "smart appliance."

Referring still to FIGS. 3 through 5, display assembly 200 may further include a screen assembly 210 that is slidably mounted to outer frame 202. More specifically, according to the illustrated embodiment, screen assembly 210 is mounted to outer frame 202 such that it may move freely along the vertical direction V. According to the illustrated embodiment, screen assembly 210 is mounted to an inner frame 212 of display assembly 200. In this regard, inner frame 212 may be a large panel that extends within the lateral direction L and the transverse direction T and which includes a mounting bracket or aperture for receiving screen assembly 210. According to the illustrated embodiment, screen assembly 210 is mounted to a top of inner frame 212.

As illustrated, inner frame 212 may be slidably mounted to outer frame 202 through a bearing assembly 214. According to the illustrated embodiment, bearing assembly 214 includes two linear ball bearings slide assemblies 216. In this manner, inner frame 212 is supported at lateral ends 218 such that it may move freely along the vertical direction V. It should be appreciated that according to alternative embodiments, any other suitable bearing assembly or low friction interface may be used to permit relative motion between inner frame 212 and outer frame 202. In addition, it should be appreciated that display assembly 200 may include any other suitable features for maintaining smooth motion of screen assembly 210, such as guide bars or alignment rods.

Figure 6:
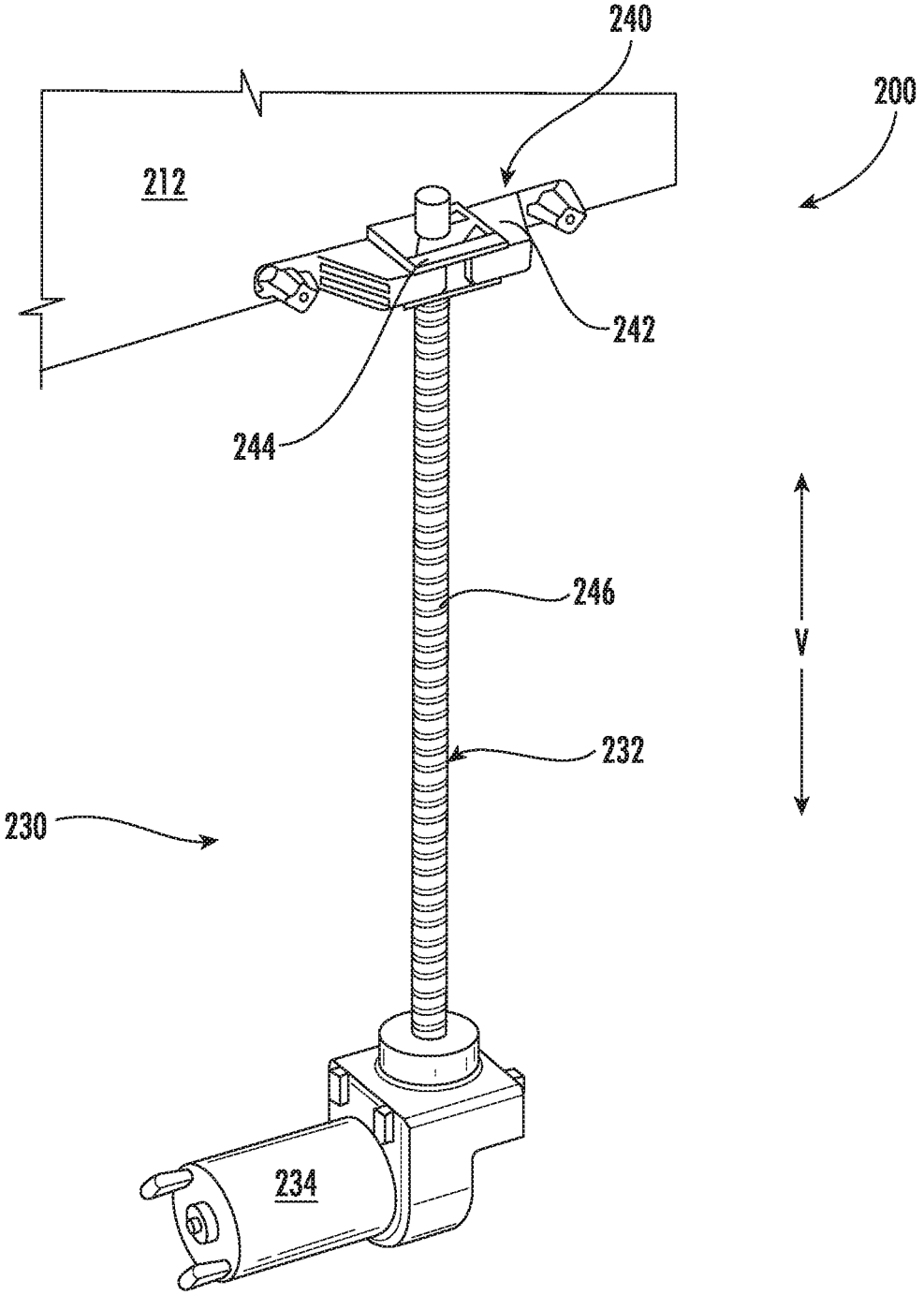
FIG. 6 provides a perspective view of a drive mechanism of the exemplary display assembly of FIG. 1 according to an exemplary embodiment of the present subject matter.
Figure 7:
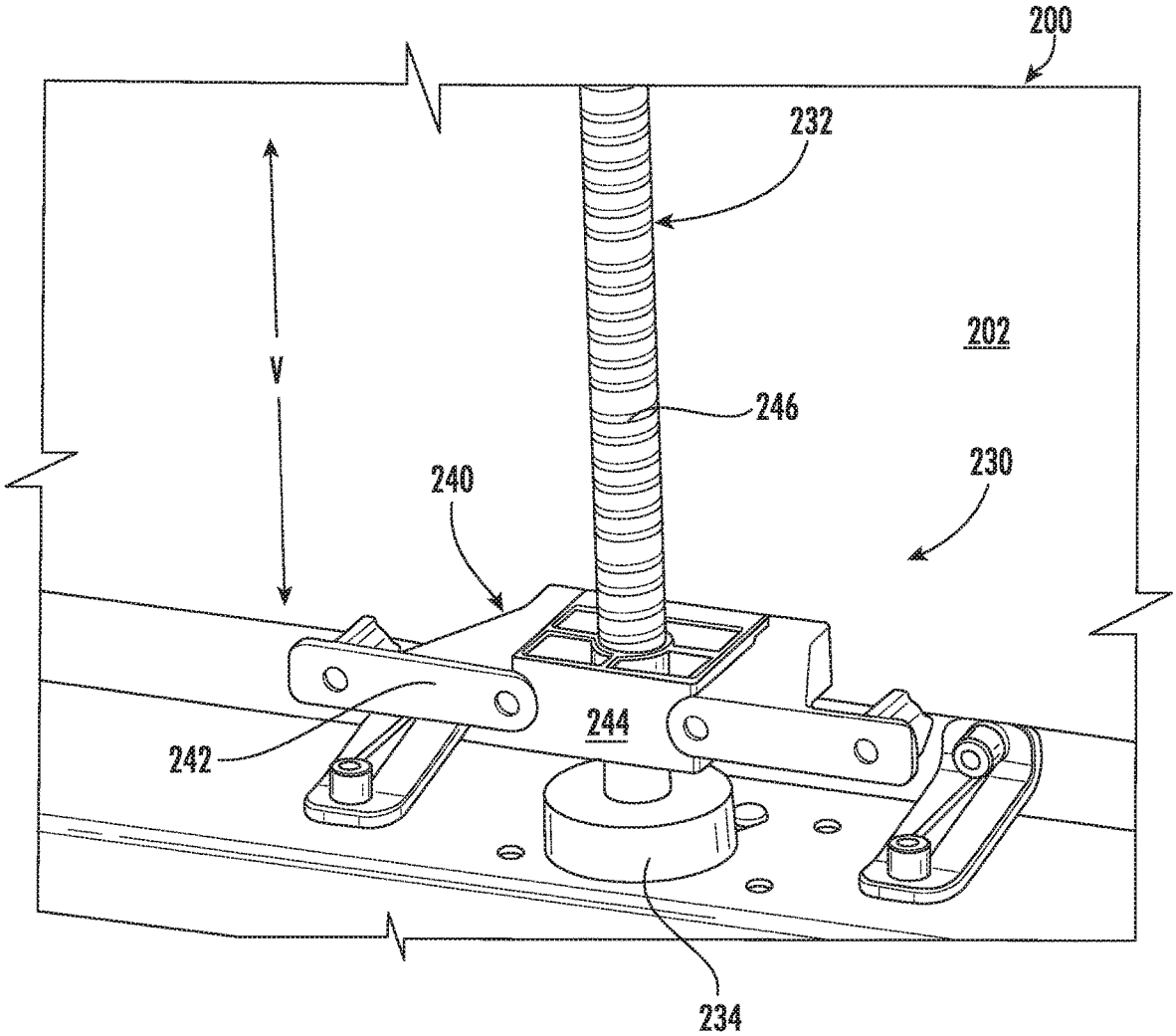
FIG. 7 provides a perspective view of a rod coupler of the exemplary drive mechanism of FIG. 6 according to an exemplary embodiment of the present subject matter.

Referring now also to FIGS. 6 and 7, display assembly 200 may include a drive mechanism 230 for selectively moving screen assembly 210 between the extended position and the retracted position. Specifically, according to the illustrated embodiment, drive mechanism 230 is mechanically coupled to screen assembly 210 for moving screen assembly 210 between the extended and retracted position.

More specifically, drive mechanism 230 may include a lead screw 232 that is mechanically coupled to screen assembly 210 or inner frame 212 and a drive motor 234 that is mechanically coupled to lead screw 232 for rotating lead screw 232 to move screen assembly 210 along the vertical direction V. According to the illustrated embodiment, lead screw 232 extends parallel to the vertical direction V to facilitate vertical movement of screen assembly 210 without binding. It should be appreciated that lead screw 232 may be mounted and supported by one or more pillow block bearings, bushings, or other suitable mounting structures (not shown), e.g., at a top and bottom of lead screw 232.

As used herein, "motor" may refer to any suitable drive motor and/or transmission assembly for rotating lead screw 232 or otherwise moving screen assembly 210 along the vertical direction V. For example, drive motor 234 may be a brushless DC electric motor, a stepper motor, or any other suitable type or configuration of motor. For example, drive motor 234 may be an AC motor, an induction motor, a permanent magnet synchronous motor, or any other suitable type of AC motor. In addition, drive motor 234 may include any suitable transmission assemblies, clutch mechanisms, or other components. According to exemplary embodiments, controller 166 may be in operative communication with drive motor 234 for regulating operation of drive motor 234 and movement of screen assembly 210.

As illustrated, lead screw 232 may be operably coupled to inner frame 212 by a rod coupler 240. Specifically, rod coupler 240 may include a mounting bracket 242 that is mechanically fastened or fixed to inner frame 212. Mounting bracket 242 may include a coupler bracket 244 that engages lead screw 232 to facilitate movement of screen assembly 210 along the vertical direction V. Specifically, as shown, lead screw 232 may be an elongated threaded shaft with screw threads 246 that are configured for engaging complementary threads (not shown) that are defined within coupler bracket 244. In this manner, as drive motor 234 rotates lead screw 232, rod coupler 240 (along with inner frame 212 and screen assembly 210) moves along the vertical direction V. As mentioned above, controller 166 may be operably coupled to drive motor 234 for selectively raising and lowering screen assembly 210.

The embodiment of display assembly 200 illustrated in FIGS. 1 through 7 includes a drive mechanism 230 having a lead screw 232 that rotates to move screen assembly 210 up or down along the vertical direction V. However, it should be appreciated that according to alternative embodiments, any other suitable drive mechanisms may be used while remaining within the scope of the present subject matter. For example, pulley systems, geared arrangements, or other suitable means for moving inner frame 212 and screen assembly 210 along the vertical direction V may be used.

Notably, it may be desirable to have a very large screen and user interface when display assembly 200 is in the extended position to facilitate improved user interaction and communication. By contrast, it may be desirable to have minimal visibility of display assembly 200 when not in use, e.g., to provide an unobtrusive look and easy to clean surfaces. Therefore, according to exemplary embodiments of the present subject matter, display assembly 200 may be designed to sit flush with a top surface 250 of oven appliance 100. Therefore, according to an exemplary embodiment, receiving slot 204 is sized for receiving all of display assembly 200 when in the retracted position. Thus, display assembly 200 (e.g., including outer frame 202, screen assembly 210, and inner frame 212) may be enclosed entirely within receiving slot 204 when in the retracted position.

Moreover, display assembly 200 may include features for disguising or minimizing its appearance when in the retracted position. For example, top surface 250 of oven appliance 100 may define an aperture 252, e.g., defining the very top opening into receiving slot 204. According to an exemplary embodiment, display assembly 200 may further include a top cap 254 that is positioned on top of screen assembly 210 and which is configured for concealing or entirely covering aperture 252 when screen assembly 210 is in the retracted position. In addition, top cap 254 may be formed from the same material as top surface 250 and may sit flush with top surface 250 along the vertical direction V, e.g., in order to minimize visibility of display assembly 200.

When in the extended position, it is desirable that screen assembly 210 is easily accessible by a user of oven appliance 100. Therefore, according to exemplary embodiments, screen assembly 210 is positioned on a top of inner frame 212 and is extended well above top surface 250 in the extended position. For example, inner frame 212 may be extended such that it provides a vertical gap 260 between top surface 250 and a bottom end 262 of screen assembly 210. In this manner, a user may manipulate screen assembly 210 without getting too close to heat generated by one or more heating elements 150 of oven appliance 100. In addition, such positioning minimizes the exposure of screen assembly 210 to oil splatter, food spillage, splashing, etc. As illustrated, screen assembly 210 extends along the entire width of oven appliance 100, e.g., to maximize visibility and screen space for user interaction.

Figure 8:
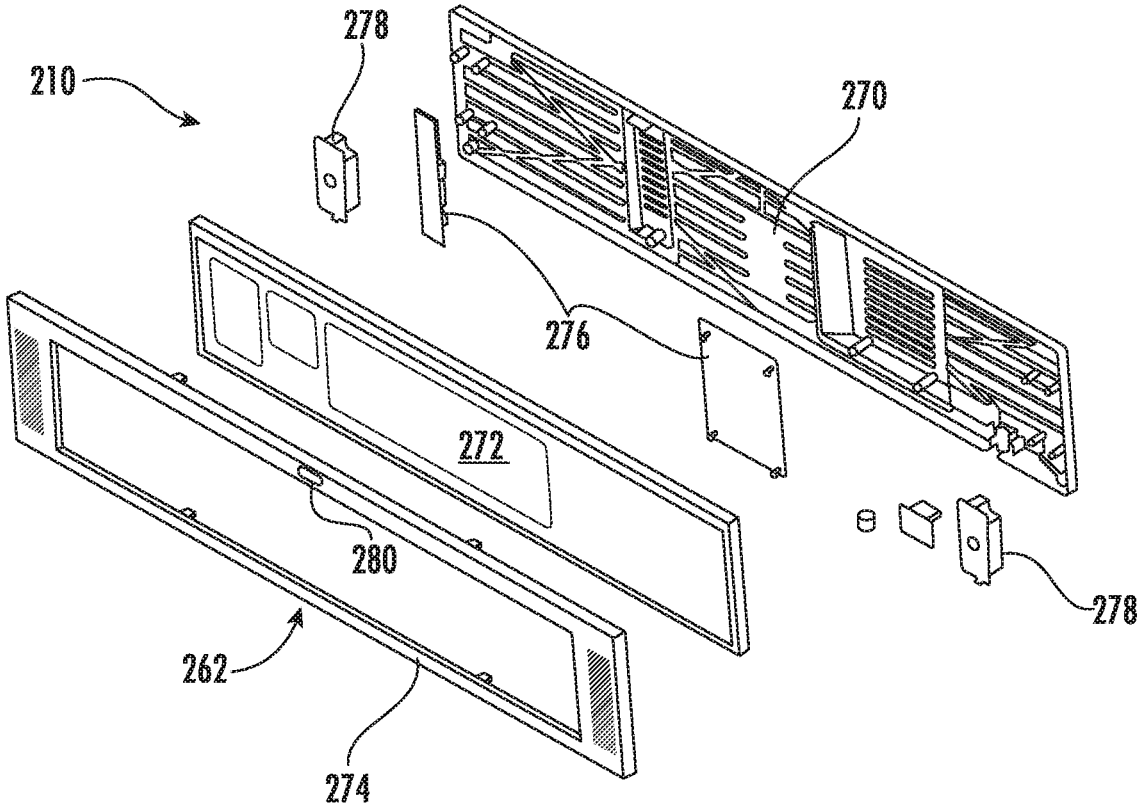
FIG. 8 provides a perspective view of a screen assembly according to an exemplary embodiment of the present subject matter.

It should be appreciated that screen assembly 210 may include any suitable number, size, and configuration of screens, microphones, speakers, indicators, cameras, or any other suitable devices for improving user interaction. For example, according to the illustrated embodiment best shown in FIG. 8, screen assembly 210 includes a rear frame 270, a liquid crystal display ("LCD") panel 272, and a front frame 274. In this regard, front frame 274 may provide a thin bezel and serve to sandwich LCD panel 272 between rear frame 270 and front frame 274. In addition, screen assembly 210 may include one or more control panels or printed circuit boards 276, speakers 278, cameras 280, and various other electronic components. As such, LCD panel 272 of screen assembly 210 provides a user with a touch sensitive interface through which they can control oven appliance 100, download online recipes, make video calls, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction, a lateral direction, and a transverse direction, the oven appliance comprising:

a cabinet; and a display assembly movably mounted to the cabinet, the display assembly comprising:

an outer frame mounted to the cabinet, the outer frame comprising a first vertical support member positioned at a first side of the cabinet and a second vertical support member positioned at a second side of the cabinet;

an inner frame positioned within the outer frame, the inner frame comprising a solid panel extending along the lateral direction between the first vertical support member and the second vertical support member;

a bearing assembly slidably coupling the inner frame to the first vertical support member and the second vertical support member of the outer frame;

a screen assembly mounted to the inner frame above the solid panel; and a drive mechanism for selectively moving the inner frame and the screen assembly between an extended position and a retracted position.

2. The oven appliance of claim 1, wherein the drive mechanism comprises:

a lead screw mechanically coupled to the screen assembly; and a drive motor operably coupled to the lead screw for rotating the lead screw and moving the screen assembly between the extended position and the retracted position.

3. The oven appliance of claim 2, wherein the lead screw defines drive threads, and wherein the drive mechanism comprises:

a rod coupler that operably couples an inner frame to the lead screw, the rod coupler defining coupler threads that are complementary to the screw threads on the lead screw.

4. The oven appliance of claim 3, wherein the lead screw extends along the vertical direction.

5. The oven appliance of claim 1, wherein a top of the screen assembly is flush with a top surface of the oven appliance when the screen assembly is in the retracted position.

6. The oven appliance of claim 1, wherein the screen assembly comprises:

a rear frame;

a liquid crystal display mounted to the rear frame; and a front frame mounted over the liquid crystal display.

7. The oven appliance of claim 1, wherein the screen assembly comprises a camera.

8. The oven appliance of claim 1, wherein the screen assembly extends along an entire width of the oven appliance.

9. The oven appliance of claim 1, wherein the screen assembly is mounted to a top of the inner frame.

10. The oven appliance of claim 1, further comprising:

an insulated cooking chamber positioned within the cabinet;

a receiving slot defined between the cabinet and the insulated cooking chamber, wherein the outer frame is mounted within the receiving slot.

11. The oven appliance of claim 10, wherein the inner frame and screen assembly are enclosed entirely within the receiving slot when in the retracted position.

12. The oven appliance of claim 10, wherein an aperture is defined in a top surface of the oven appliance for receiving the screen assembly, and wherein the display assembly further comprises:

a top cap positioned on top of the screen assembly, the top cap being configured for concealing the aperture when the screen assembly is in the retracted position.

13. The oven appliance of claim 1, wherein the outer frame is mounted on an outer surface of the cabinet.

14. A display assembly for an appliance, the appliance comprising a cabinet defining a vertical direction and a lateral direction, the display assembly comprising:

an outer frame mounted to the cabinet, the outer frame comprising a first vertical support member positioned at a first side of the cabinet and a second vertical support member positioned at a second side of the cabinet;

an inner frame positioned within the outer frame, the inner frame comprising a solid panel extending along the lateral direction between the first vertical support member and the second vertical support member;

a bearing assembly slidably coupling the inner frame to the first vertical support member and the second vertical support member of the outer frame;

a screen assembly mounted to the inner frame above the solid panel; and a drive mechanism for selectively moving the inner frame and the screen assembly between an extended position and a retracted position.

15. The display assembly of claim 14, wherein the drive mechanism comprises:

a lead screw mechanically coupled to the screen assembly; and a drive motor operably coupled to the lead screw for rotating the lead screw and moving the screen assembly between the extended position and the retracted position.

16. The display assembly of claim 14, further comprising:

an insulated cooking chamber positioned within the cabinet;

a receiving slot defined between the cabinet and the insulated cooking chamber, wherein the outer frame is mounted within the receiving slot.

17. The display assembly of claim 16, wherein the inner frame and screen assembly are enclosed entirely within the receiving slot when in the retracted position.

18. The display assembly of claim 14, wherein the outer frame is mounted on an outer surface of the cabinet.

19. The oven appliance of claim 1, wherein the inner frame defines a vertical gap between a top surface of the oven appliance and a bottom end of the screen assembly when in the extended position.

20. The display assembly of claim 14, wherein the inner frame defines a vertical gap between a top surface of the oven appliance and a bottom end of the screen assembly when in the extended position.

* * * * *